106-90 AU 118 EX
12/24/85 OR 4,560,411

United States Patent [19]
Melchior

[11] Patent Number: 4,560,411
[45] Date of Patent: Dec. 24, 1985

[54] AGGREGATE FOR CONCRETE OR MORTAR

[75] Inventor: Bernd Melchior, Remscheid, Fed. Rep. of Germany

[73] Assignee: BM Chemie Kunststoff GmbH, Wermelskirchen, Fed. Rep. of Germany

[21] Appl. No.: 496,496

[22] Filed: May 20, 1983

[51] Int. Cl.[4] ..... C04B 7/35
[52] U.S. Cl. ..... 106/90; 106/93; 106/99
[58] Field of Search ..... 106/90, 93, 99

[56] References Cited

U.S. PATENT DOCUMENTS

| | | | |
|---|---|---|---|
| 3,684,474 | 8/1972 | Chisholm | 106/99 |
| 3,953,953 | 5/1976 | Marsden | 106/99 |
| 3,980,484 | 9/1976 | Shaw | 106/99 |
| 4,033,781 | 7/1977 | Hauser et al. | 106/99 |

FOREIGN PATENT DOCUMENTS

| | | | |
|---|---|---|---|
| 2342770 | 4/1975 | Fed. Rep. of Germany | 106/99 |
| 49-37407 | 10/1974 | Japan | 106/99 |
| 0135170 | 8/1983 | Japan | 106/99 |
| 592890 | 10/1947 | United Kingdom | 106/99 |

*Primary Examiner*—Andrew H. Metz
*Assistant Examiner*—Terryence Chapman
*Attorney, Agent, or Firm*—Karl F. Ross; Herbert Dubno

[57] ABSTRACT

The invention relates to a filiform addition for concrete or mortar consisting of a filament or a filament bundle. The filament or filament bundle carries at least one body having a diameter larger than the thickness of the filament or filament bundle. At the same time, the length of the filament or filament bundle is greater than the diameter of the body.

16 Claims, 26 Drawing Figures

AGGREGATE FOR CONCRETE OR MORTAR

FIELD OF THE INVENTION

The invention relates to a filiform addition for concrete or mortar, particularly filament sections of a metal, mineral or synthetic material.

BACKGROUND OF THE INVENTION

It is known to admix inorganic or organic filaments with concrete in order to increase the strength of the concrete. Usually, these filaments do not disperse sufficiently uniformly and in particular build up procupine-like accumulations, the concrete after hardening does not have uniform strength. Also, the filaments can not have any desired thickness, since during the mixing operation very thin filaments do not maintain a longitudinal extension, but are mostly cropped together.

Hollow balls of polystyrene foam form light additives, which reduce the thermal conductivity of the concrete. This addition also reduces the strength of the concrete. The polystyrene balls float upwards easily during the mixing of the concrete, and may not be evenly distributed.

OBJECTS OF THE INVENTION

It is an object of the invention to provide a filiform additive for concrete or mortar which disperses uniformly in concrete and whose filaments maintain a sufficient longitudinal extension.

It is a further object of the invention to provide a filiform additive for concrete or mortar whereby the thickness of the filaments can be very much reduced.

Further it is an object of the invention to create a light additive, which only slightly reduces the tensile strength of the concrete and does not float in the concrete.

It is also an object of the invention to create a filiform additive for concrete or mortar, which can be mass-produced economically.

Further it is the object of the invention to present a simple and economical process for the production of a filiform additive.

SUMMARY OF THE INVENTION

According to the invention, these objects are attained such that the filament or the filament bundle includes at least one body, whose diameter is larger than the thickness of the filament or filament bundle.

The filament or filament bundle passes through the body of the additive and has an adequate contact with the binding means of the concrete or mortar through the remaining filament length on both sides at the outside of the granule, contact being made over a length sufficient for adhesion. Though the filaments or the filament bundles have no direct contact with the binding means in their median area, a sufficient hold is created and the tensile strength in the area of the additive, particularly in the case of a light addition, is increased, so that the light additive is not required to have its own granular strength. As a result of the fact that the body positioned on the filament or filament bundle ensures that the filament or filament bundle remains extended at least over the area of the body, a knotting of the filament is sufficiently prevented. The porcupine aggregation no longer results. Moreover, very thin filaments can be used, so that it is possible to go as low as the tearing limit of the filament and by this the proportion of the filaments can be reduced. It is possible, for instance in the case of steel filaments, to reduce the proportion of the steel by approximately one half. Moreover, it is an advantage in the case of thinner filaments, a shorter length to be put under load suffices, thereby reducing again the proportion of the product which is constituted by filaments. Such an additive is particularly suitable for injection concrete, since the filaments partially enveloped by bodies have reduced rebound.

The additive according to the invention is particularly appropriate for light concrete, since in the case of a body made of light material of relatively reduced strength the tensile strength of the concrete is improved because the filaments be exactly in the spots where the concrete is weakened because of the light additive. Also, such a light additive does not float in the concrete. A light concrete with excellent thermal insulation properties and a high tensile and compression stength is obtained.

It is advantageous to have the filament or filament bundle run through the middle of the body since, in this case, the traction forces acting upon the hollow space of the solid concrete or mortar are taken over by the filament or filament bundle in the best possible way. Both ends of the filament or filament bundle are not to be surrounded by such a body, in fact they should be free to allow these ends to anchor themselves in the binding means of the concrete or mortar. A portion of the filament or filament bundle has to protrude from both sides of the body for this purpose, or another body borders the body, from said further body a filament or filament bundle protrudes again from the side averted from the first body.

In the body two or more filaments or filament bundles can cross each other. Thereby, within one body a tensile strength in two or more directions different with respect to each other can be achieved. Especially advantageous is the fact that when the filaments or filament bundles cross each other at approximately a right angle the best possible uptake of forces being thus insured. It is also possible with the invention to cross three filaments or filament bundles corresponding to three spacial axes, mutually perpendicular.

Larger additives with a reduced material share of the filaments as well as of the bodies and with high tensile strength are achieved by providing that in two or more bodies on a filament or filament bundle each body carries in addition filaments or filament bundles arranged transverselly to the first filament or filament bundle. Advantageously it is proposed in this context that three, four, or more bodies be traversed by three, four or more filaments or filament bundles, each of them traversing at least two bodies. In this way additives arranged over large areas or spaces can be created.

The diameter of the body should be a multiple of the thickness of the filaments or filament bundles, since the filament or filament bundles can be advantageously thin. Thereby the diameter of the body can be 10–1000 times larger than the thickness of the filament or filament bundle. Advantageously the diameter of the bodies is no larger than one third of the length of the filament or filament bundle. The body can consist of a mineral, synthetic material or cellulose.

A particularly light additive and consequently a light concrete is obtainable by having the body and/or the material of the body of a lower density than the remaining components of the concrete or mortar. The body can have one or more cavities. Advantageously, the body consists of hardened foam. The body can consist of a synthetic material foam, especially a polystyrene foam.

The body can be manufactured simply and economically when it is shaped as a ball, a drop, a cylinder or a parallelepiped. The globe shape is especially advantageous, since the hollow space, free of binding means, created in the concrete or mortar by a globe due to its shape and the central crossing by a filament or filament bundle, can take up particularly high compression forces.

An exceptionally good hold of the additive in concrete or mortar is obtained when the ends of the filament or filament bundle are bent, especially in a hook-like shape.

Advantageously, two or more bodies on a filament or filament bundle can be arranged, particularly fastened, at intervals or adjacently. Thereby, long, chain-like additions can be created, without the danger that the additions get tangled. Advantageously the bodies can be attached by casting, melting, welding, dipping, gluing or individual molding to the filament or filament bundle. However the filament or filament bundle and the body can be of the same material.

The filament can be made of a cord of synthetic material, having a glass fiber or a steel wire. Alternately, the filament or filament bundle can consist of at least two individual filaments, twined together. One of these individual filaments is then a synthetic material fiber.

A particularly advantageous additive is created by closing the filament or filament bundle to the shape of a ring. Thereby a safe anchoring in the binding means together with a simple manufacturing process and a good dispersion in concrete or mortar results. Advantageously, at least two bodies can be located on the ring.

In order to manufacture such a ring the ends of the sections of filament or filament bundle can be twisted, welded or soldered together. Alternatively or additionally, the ends of the sections of the filament or filament bundle can be fastened to each other by a body, particularly a drop of synthetic material. A safe fastening of the ends of the filament or filament bundles is obtained by having both ends of a filament or filament bundle section inserted respectively or ending in a body. Thereby the ends can be inserted in different bodies. It is also an advantage to have the filament or filament bundle doubled, at least over one portion of the ring.

A simple process for economically manufacturing the addition is created by applying thermoplastic synthetic-material bodies to a hot filament or hot filament bundle and remelting the filament or filament bundle. This process as well as the processes further described allow a continuous and automatic production.

An alternative process consists in applying a soft synthetic material on the filament or filament bundle, particularly by pouring, dripping or impressing. It is also proposed to make the synthetic material bodies of a motion-restrictive material, especially polystyrene or synthetic resin. Thereby, after the application of the synthetic-material bodies, these can be foamed, especially through a supply of energy.

A motion-restrictive plastic fiber, especially a plastic fiber intertwined with a steel wire can be foamed spottily through partial energy supply, particularly partial heating. After the application of the synthetic-material body on a long filament or filament bundle running by, the filament or filament bundle can be cut into sections carrying bodies.

A further advantageous manufacturing process consists in that on several very long filaments or filament bundles, positioned parallel to each other in a plan, strands of the material of the body, especially synthetic material are positioned parallel to each other and arranged across the filaments or filament bundles, especially through melting or due to the soft consistency of the material and the filaments or filament bundles and the strands are cut to the desired length thereafter.

An advantageous manufacturing process is also created by providing that on several filaments or filament bundles positioned parallel to each other in a plane, filaments or filament bundles are arranged parallel to each other and across the first filaments or filament bundles; at their crossing points bodies, especially globes, beads or drops of synthetic material are melted on, poured on or impressed. This process facilitates production of additives having not only one body but also several.

In all these processes the filaments and the synthetic material can be moved during production continuously or stepwise especially towards a cutting device in a direction of the longitudinal axis of the filament or transversally thereto. A particularly fast and safer attachment of the bodies on the filaments or filament strands is achieved by having the bodies or the strands rolled onto the filaments. Thereby the rolls can have notches or recesses, carrying or guiding the strand-like material of the bodies, or the individual bodies.

BRIEF DESCRIPTION OF THE DRAWING

Embodiments of the invention are represented partially schematically in the drawing in which.

SPECIFIC DESCRIPTION

Figure 1:
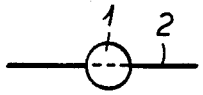
FIG. 1 a view of an additive with a globe-shaped body and a single filament.

The basic principle represented in FIGS. 1 to 7 consists in having an additive granule or part, referred to as body 1 below, traversed through its center, particularly diametrally by a filament section 2 or a filament bundle 3, in such a way that the filament 2 or the filament bundle 3 carries in its middle area the body 1 and the free segments or ends protrude from the body 1 so that the filament segment or the filament bundle is always longer than the diameter of the body 1 or of several adjacent bodies and the portions of the filament or filament bundle protruding from the opposite sides are embedded in the binding means of the concrete or mortar and thereby anchored. The filaments 2 or filament bundles 3 take up the traction forces, while the body 1 ensures that the filaments or filament bundles remain straight at least over the areas of the body and prevent their tangling with other filaments and development of porcupine like aggregations. In all drawing figures, whenever a filament 2 is shown a filament bundle 3 can also be used.

Since the filaments 2 are kept in place by the body 1, the filaments can have a very reduced thickness, especially in the case of steel filaments having a thickness on the order of 0.03 to 0.3 mm. The diameter of the body 1 amounts to a multiple of the thickness of the filaments or filament bundles. Particularly, the diameter of the body is 10 to 1000 times larger than the thickness of a filament or filament bundle. On the other hand, the length of a filament or filament bundle is greater than the diameter of the body, whereby the filament or filament bundle should be more than three times longer than the diameter of the body. The material of the body is a mineral, a synthetic material or cellulose or mixtures of the same whereby it is an advantage when these materials have a lower density than the binding means of the concrete or mortar. A reduction of the weight of the body is obtained when the body is hollow or presents several cavities. In this case, the body can be made of hardened foam, especially of a foam of synthetis material as for instance a polystyrene foam. Also dross, synthetic resins, polymer, glass and others can be used.

The bodies 1 and 1' to 1''' are attached on the filament or filament bundle by casting, melting, welding, dipping or gluing. The filament can be made of the widest variety of materials and particularly of the same material as the body. Steel and synthetic materials as well as a silicate such as dross or glass are particularly suited as materials for filaments. Combination of those materials can be advantageous, particularly the filament can be made of a synthetic material cord having a glass fiber or a steel wire. Further the filament can be made of individual filaments twined or twisted together. This way the filaments can also be sections of cable.

Figure 2:
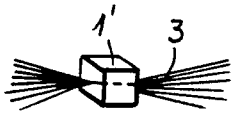
FIG. 2 a view in perspective of an additive with a cubical body.
Figure 3:
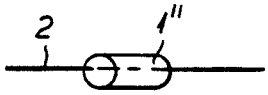
FIG. 3 is a view of an additive with cylindrical body.
Figure 4:
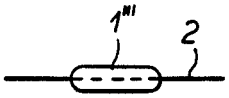
FIG. 4 is a view of an additive with a an oblong body.
Figure 5:
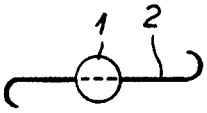
FIG. 5 is a view of an additive with a globe-shaped body and bent filament ends.
Figure 15:
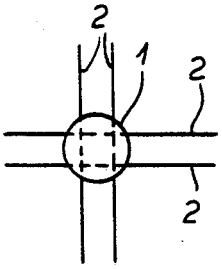
FIG. 15 is a view of four filaments, two of which cross the other two at a right angle and the four crossing points are surrounded by a single globe- or disk-shaped body.

The body 1 can have the most various shapes. In FIG. 2 it is parallelepipedic or cubic, in FIG. 3 it is cylindrical, in FIG. 4 elongated or oval, in FIG. 15 disk-shaped and also a drop shape or the shape of an irregular lump is acceptable.

Figure 6:
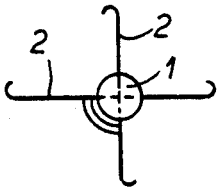
FIG. 6 is a view of an additive with globe-shaped body and two filaments crossing each other at a right angle in the same body.
Figure 7:
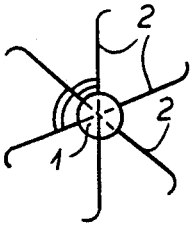
FIG. 7 is a view of a globe-shaped body with three filaments crossing each other at right angles.
Figure 8:
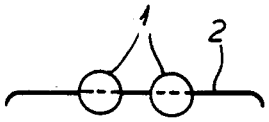
FIG. 8 is a view of an additive with two globe-shaped bodies arranged at a distance from each other.

In the body 1 two or more filaments or filament bundles can cross each other. Thereby, as shown in FIGS. 6 and 7, two or three filaments can be at a right angle with respect to each other, so that they form two or three spacial axes. The ends of the filament or filament bundles can be bent in order to have a better hold in the binding means, (FIGS. 5 to 13).

Figure 12:
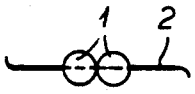
FIGS. 12 and 13 are views of two or three adjacent globe-shaped bodies on a filament.
Figure 13:
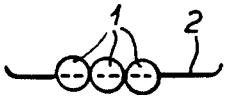
Figure 14:
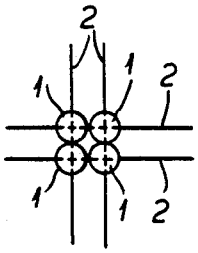
FIG. 14 is a view of four globe-shaped bodies arranged closely to each other in a square with four filaments, crossing each other at a right angle.

As shown in FIGS. 8 to 26, two or several bodies can be attached on a single filament section or filament-bundle section. Thereby, the bodies can be arranged at intervals (FIGS. 8 to 11) or closely adjacent and touching (FIGS. 12 to 14). In the case of a close positioning, as well as in the case of the elongated body corresponding to FIGS. 3 and 4 a relatively long rigid portion of the filament or filament bundle results.

Figure 9:
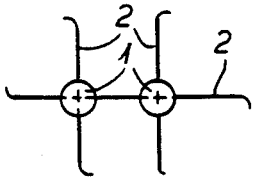
FIG. 9 is a view of an additive according to FIG. 8 with additional transversally arranged filaments per body.
Figure 10:
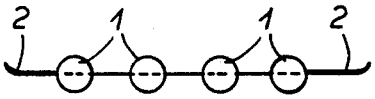
FIG. 10 is a view of a filament with several bodies arranged at intervals.
Figure 11:
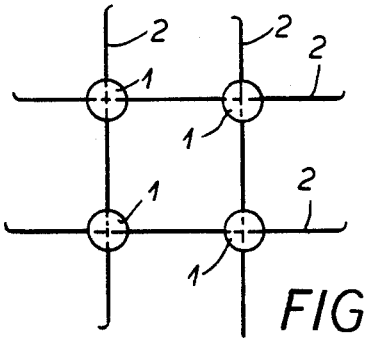
FIG. 11 is a view of four filaments each two of which are parallel and crossing the other two at a right angle with globe-shaped bodies fastened at their crossing points.

When several bodies are provided on a filament or filament bundle it is possible to provide in each body further filaments or filament bundles which cross the first filament especially at a right angle. This is represented in FIG. 9 by two bodies and in FIGS. 11 and 14 by four bodies. Thereby it is possible, as shown in FIGS. 11 and 14 to have the filaments or filament bundles arranged as a lattice. While in FIG. 11 the four crossing points of the four filaments are surrounded by four individual bodies 1, in FIG. 15 the filaments arranged in pairs are so close to each other that the interval between crossing points are so close to each other that they are surrounded by one single body 1.

Figure 16:
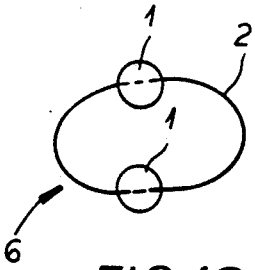
FIG. 16 is a view of an additive wherein the filament or filament boundle is shaped as a ring and has two globe-shaped bodies.
Figure 17:
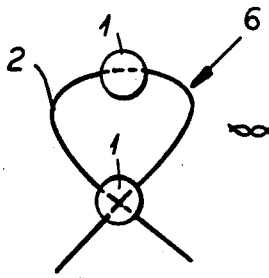
FIG. 17 is a view of a ring with filament ends crossing each other whereby the crossing point is held by a globe-shaped body.
Figure 18:
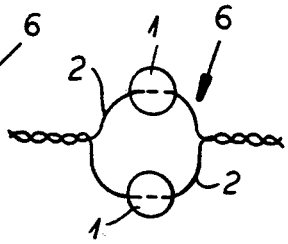
FIG. 18 is a view of a ring made of two filaments each carrying a body and having their ends twisted together.
Figure 19:
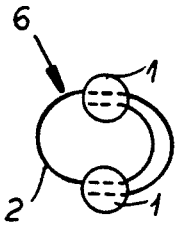
FIGS. 19 and 20 are views of a ring with two or three bodies whereby the ends of the filament are inserted in a globe-shaped body and a portion of the ring between two bodies is doubled.
Figure 20:
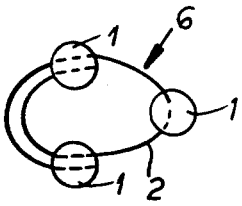

The filament 2 or the filament bundle 3 form in FIGS. 16 to 20 a closed ring 6, whereby in FIG. 16 the ends are welded or soldered together, in FIG. 17 the ends are surrounded and held at the crossing point by a body 1 and the free ends extend beyond this body, in FIG. 18 the ends of two filaments or filament bundles are twisted together and in FIGS. 19 and 20 the ends are inserted, respectively with one end each in separate bodies, whereby in one portion of the ring, respectively in one ring segment between two bodies the filaments or filament bundles are doubled.

In the following description, various processes for the production of the additive are described. Corresponding to FIG. 24 thermoplastic synthetic-material bodies 1 are applied through funnels or feeding pipes 7 on a hot filament or hot filament bundle 2, whereby the body melts on the filament or the filament bundle. The synthetic material can be motion-restrictive and consist of polystyrene, so that by a supply of energy through UV- or Infrared radiations 8 the relatively small globes, shown in FIG. 24 to the left, remelt. Afterwards, they can harden due to redox polymerization. After the hardening, the filament or filament bundle is divided at the line 5 into individual sections creating thereby the desired addition. In the process as shown in FIG. 24, the additive has bodies 1 arranged at a distance on a single filament 2.

Figure 24:
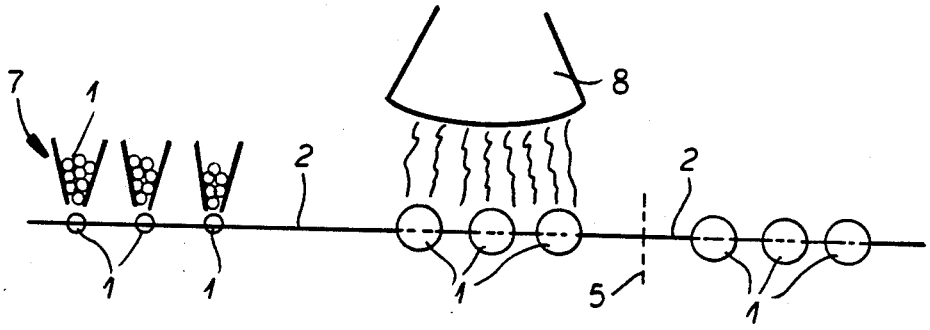
FIG. 24 is a view of a schematic representation of a production process, wherein bodies of a thermoplastic synthetic material are melted on a hot filament or hot filament bundle.
Figure 25:
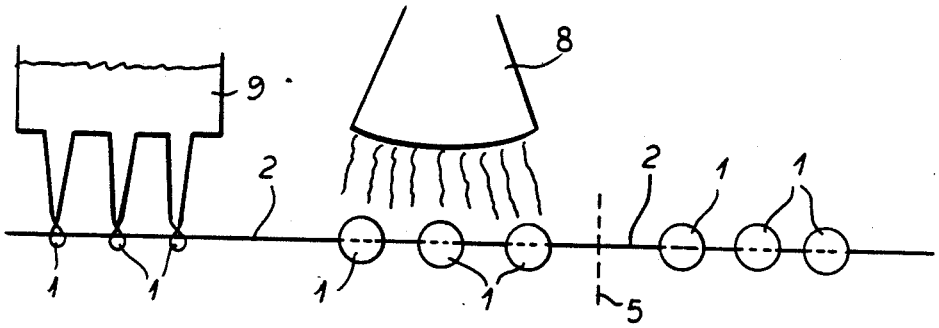
FIG. 25 is a view of a schematic representation of a production process with soft synthetic material poured on the filament or filament bundle.

The process shown in FIG. 25 differs from the one in FIG. 24 only in that a fluid synthetic material or another fluid hardenable material is applied through application nozzles of a container 9 in drops to the not particularly heated filament or filament bundle 2, in order to foam up again, to harden and to be cut thereafter. In the case of these two processes, as well as of the following one the filament runs forwardly, continuously or stepwise, making possible automation of the manufacturing process.

Figure 26:
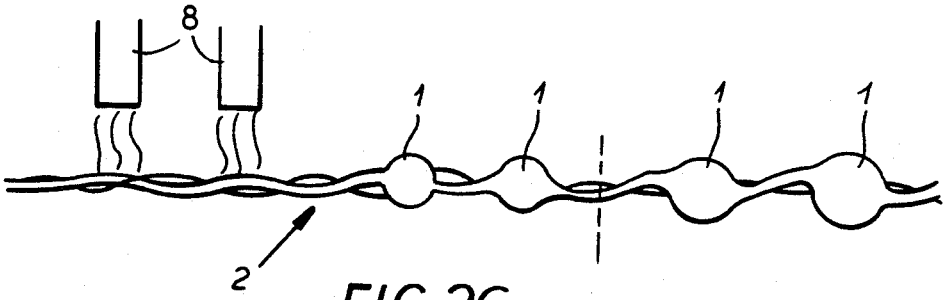
FIG. 26 is a view of a schematic representation of a production process with motion-restrictive synthetic material filament, heated spottily in order to foam up.

In the process shown in FIG. 26 the filament consists of a motion-restrictive synthetic material to which energy, particularly heat, is supplied only to the spots where the synthetic material must foam up to form bodies 1. Around the cord of synthetic material another filament, particularly a steel filament can be wound in order to take up the traction forces and form a composite filament 2. Alternately, the filament taking up the traction forces can be also positioned inside the synthetic-material cord.

Figure 21:
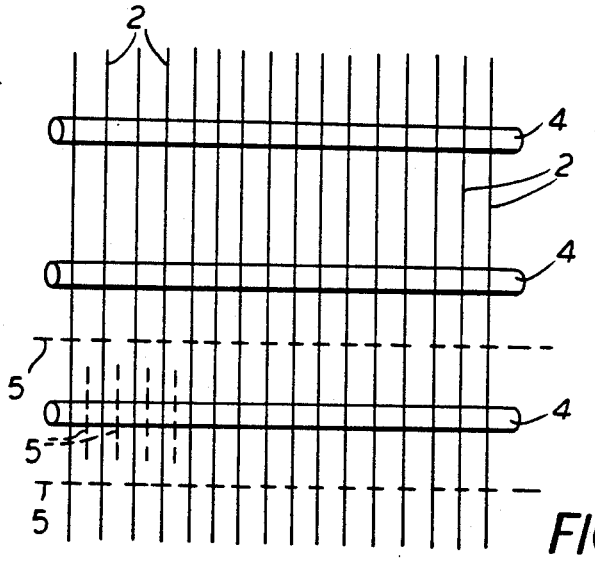
FIG. 21 is a view of a lattice of parallel filaments, having strands of synthetic material melted on at a right angle thereto, in order to create after the cutting operation an additive as shown in FIG. 22.
Figure 22:
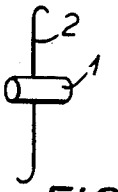

According to the process shown in FIG. 21, a number of filaments 2 parallel to each other are covered by strands of material 4 made especially of synthetic material and arranged transversally, particularly at a right angle with regard to said filaments. By melting or impressing the filament or filament bundle in the strands 4 a lattice results, which is cut along the dotted line 5 in order to obtain the desired additive. Thereby it is possible to obtain different sizes of additions only by establishing the cutting line. The strands 4 as well as the filaments 2 are cut to form respective filament bundles. During a continuous production process the lattice can be moved either in the longitudinal direction of the strands or the filaments or filament bundles.

Figure 23:
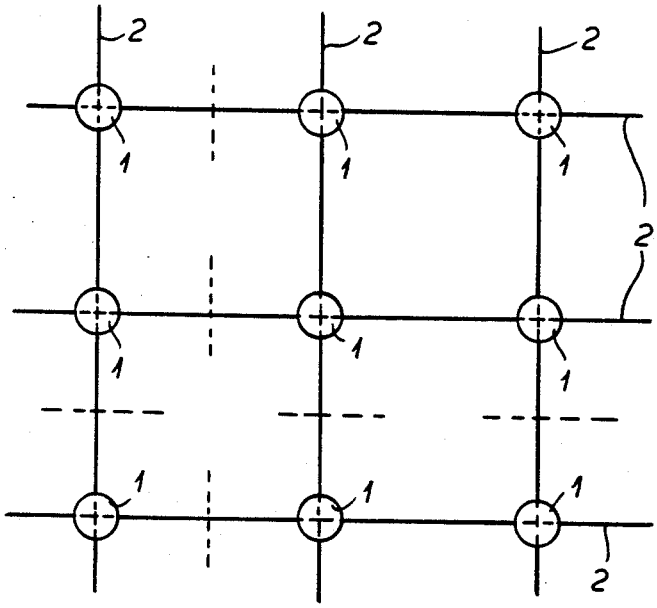
FIG. 23 is a view of a lattice of crossed filaments with globe- or disk-shaped bodies fastened to the crossing points, in order to obtain individual additive sections after a median sectioning of the filaments.

The process represented in FIG. 23 differs from the one in FIG. 21 in that the entire lattice consists of filaments or filament bundles 2 which are arranged perpendicularly to each other, whereby the crossing points are surrounded by bodies 1 which are melted, poured or impressed thereon. The lattice can again be cut at different points 5, in order to obtain additives of various sizes as needed. In accordance to the cutting points in FIG. 23 additives corresponding to FIGS. 6, 9 and 11 are obtained. For a continuous production process the lattice shown in FIG. 23 can be moved in both directions of the filaments or filament bundles 2.

A simple, precise and fast application of the strands 4 in FIG. 21 and the bodies 1 in FIG. 23 is achieved by rolling them onto the filaments or filament bundles 2, whereby the rollers for the strands 4 are provided with notches and with mold-shaped recesses for the bodies 1, in order to impress the material of the bodies on the filament or filament bundle with high precision.

I claim:

1. In a granular concrete and mortar composition, the improvement comprising using a granular concrete and mortar aggregate which consists of a body traversed by at least one filament whose length is greater than that of the body and whose diameter is smaller than that of the body so that portions of the filament whose lengths are greater than that of the portion of the filament within the body project from opposite sides of the body.

2. The aggregate defined in claim 1 wherein a bundle of such filaments all traverse said body and have portions extending codirectionally on opposite sides of said body.

3. The aggregate defined in claim 1 wherein said filament extends into another such body spaced from the first mentioned body by a distance greater than the length of the portion of said filament within the first mentioned body.

4. The aggregate defined in claim 1 further comprising at least one other filament traversing said body in a direction perpendicular to the first mentioned filament and having portions extending from opposite sides of said body of lengths greater than the length of said filament within said body.

5. The aggregate defined in claim 4 further comprising other filaments traversing each of said bodies in a direction perpendicular to the first mentioned filament and having portions extending from opposite sides of each of said granules of lengths greater than the lengths of said other filaments within said granules.

6. The aggregate defined in claim 5 further comprising additional such bodies traversed by each of said other filaments.

7. The aggregate defined in claim 1 wherein the diameter of said body is 10 to 1000 times greater than the thickness of said filament and the diameter of said body is not greater than one-third the length of said filament.

8. The aggregate defined in claim 7 wherein said body is composed of a material selected from the group which consists of a mineral, synthetic resin and cellulose.

9. The aggregate defined in claim 7 wherein said body is composed of a material having a density less than that of other components of the concrete or mortar.

10. The aggregate defined in claim 7 wherein said body has at least one cavity.

11. The aggregate defined in claim 1 wherein said filament has ends bent respectively in hook shape.

12. The aggregate defined in claim 1 wherein said filament forms a ring.

13. A process for making the aggregate defined in claim 1 which comprises the steps of:

applying drops of a thermoplastic synthetic resin to a heated filament and fusing said filament thereto; and cooling said drops.

14. The process defined in claim 13 wherein said synthetic resin is polystyrene.

15. A method of making the aggregate defined in claim 1 which comprises the steps of:

embedding said filament in a body of a foamable material; and thereafter foaming said body.

16. A method of making the aggregate defined in claim 1 which comprises the steps of:

applying bodies to a length of said filament at spaced apart locations; and thereafter cutting said filament between said bodies into sections carrying said bodies.

* * * * *